US010072843B2

(12) United States Patent
Baramov et al.

(10) Patent No.: US 10,072,843 B2
(45) Date of Patent: Sep. 11, 2018

(54) COMBUSTION RESONANCE SUPPRESSION

(71) Applicant: Honeywell International Inc., Morristown, NJ (US)

(72) Inventors: Lubomir Baramov, Prague (CZ); Curtis L. Taylor, Gaston, IN (US)

(73) Assignee: Honeywell International Inc., Morris Plains, NJ (US)

( * ) Notice: Subject to any disclaimer, the term of this patent is extended or adjusted under 35 U.S.C. 154(b) by 413 days.

(21) Appl. No.: 14/919,085

(22) Filed: Oct. 21, 2015

(65) Prior Publication Data

US 2017/0115004 A1 Apr. 27, 2017

(51) Int. Cl.

| | |
|---|---|
| ***F23N 5/18*** | (2006.01) |
| ***F23N 1/00*** | (2006.01) |
| ***F23N 1/02*** | (2006.01) |
| ***F23N 5/08*** | (2006.01) |
| ***F23N 5/16*** | (2006.01) |

(52) U.S. Cl.

CPC ..... *F23N 5/184* (2013.01); *F23N 1/002* (2013.01); *F23N 1/02* (2013.01); *F23N 1/022* (2013.01); *F23N 5/082* (2013.01); *F23N 5/16* (2013.01); *F23N 2023/04* (2013.01); *F23N 2023/08* (2013.01); *F23N 2025/04* (2013.01)

(58) Field of Classification Search

CPC ..... F23N 1/00; F23N 5/18; F23N 1/02

USPC ..... 431/12, 2, 19, 75; 60/39.826, 39.77

See application file for complete search history.

(56) References Cited

U.S. PATENT DOCUMENTS 4,959,638 A * 9/1990 Palmer ..... F23N 5/16 340/577
5,164,600 A * 11/1992 Das ..... F23N 5/082 250/226
5,428,951 A * 7/1995 Wilson ..... F23C 99/00 431/1
5,665,916 A * 9/1997 Puster ..... F23N 5/16 73/114.43

(Continued)

FOREIGN PATENT DOCUMENTS

EP 1557609 A1 1/2004
EP 1632718 A2 8/2005

(Continued)

OTHER PUBLICATIONS

Lieuwen, T., et al., "The Role of Equivalence Ratio Oscillations in Driving Combustion instabilities in low NOx Gas Turbines", Twenty-Seventh Symposium (International) on Combustion/The Combustion Institute, 1998, pp. 1809-1816.

(Continued)

*Primary Examiner* — Gregory Huson
*Assistant Examiner* — Nikhil Mashruwala
(74) *Attorney, Agent, or Firm* — Anthony Miologos

(57) ABSTRACT

Methods, devices, and systems for combustion resonance suppression are described herein. One device includes a memory, and a processor configured to execute executable instructions stored in the memory to receive a number of operating conditions of a burner, determine whether resonance characteristics are present in a combustion chamber housing the burner based on the number of operating conditions of the burner, and modify at least one of an air supply and a fuel supply to the burner upon determining resonance characteristics are present in the combustion chamber.

18 Claims, 4 Drawing Sheets

(56) References Cited

U.S. PATENT DOCUMENTS 5,719,791 A * 2/1998 Neumeier ..... F23N 5/16 310/51
5,784,889 A * 7/1998 Joos ..... F23C 99/001 431/114
6,285,765 B1 * 9/2001 Quan ..... H04N 5/913 380/204
6,461,144 B1 * 10/2002 Gutmark ..... F23M 20/005 381/71.2
6,840,046 B2 * 1/2005 Paschereit ..... F02C 9/28 60/725
7,457,710 B2 * 11/2008 Schuermans ..... F23N 5/16 702/30
8,297,060 B2 * 10/2012 Myhre ..... F01D 17/02 60/740
8,522,561 B2 * 9/2013 Rogers ..... F23R 3/286 60/725
8,776,584 B2 * 7/2014 Hoehne ..... G01M 15/14 73/112.01
8,881,535 B2 * 11/2014 Hartwick ..... F23D 14/84 431/8
2004/0123652 A1 7/2004 Benson et al.
2014/0030662 A1 1/2014 Noman
2014/0038113 A1 2/2014 Breidenthal et al.
2014/0199641 A1 * 7/2014 Chian ..... F23Q 7/26 431/6

FOREIGN PATENT DOCUMENTS

EP 1923633 A2 10/2007
EP 2372246 A2 3/2011

OTHER PUBLICATIONS

Peracchio, A., et al., "Nonlinear Heat-Release/Acoustic Model for Thermoacoustic Instability in lean Premixed Combustors", Journal of Engineering for Gas turbines and Power, Jul. 1999, vol. 121, pp. 415-421.
Dunstan, W., et al., "Fitting nonlinear low-order models for combustion instability control", Control Engineering Practice, 9 (2001), pp. 1301-1317.
Bouziani, F., et al., "Analysis of a tractable model for combustion instability: the effect of delay and low pass filtering", 45th IEEE Conference on Decision and Control, 2006, pp. 6708-6713.

* cited by examiner

COMBUSTION RESONANCE SUPPRESSION

TECHNICAL FIELD

The present disclosure relates to methods, devices, and systems for combustion resonance suppression.

BACKGROUND

Combustion resonance is a phenomenon that can occur in many combustion devices, such as, for instance, industrial heaters, gas turbines, and jet and rocket engines. Combustion resonance can be caused by the acoustics of a combustion chamber of the combustion device interacting with a flame in the combustion chamber. For example, the acoustics of the combustion chamber can interact with the flame to cause pressure oscillations in the combustion chamber.

The pressure oscillations caused by the interaction of the acoustics and the flame can resonate within the combustion chamber. For example, if left unimpeded, the pressure oscillations can grow in magnitude. The resonance can result in significant damage to the combustion device, including flame extinction, equipment fatigue, and/or equipment failure.

Previous approaches to prevent combustion resonance have included redesigning the combustion chamber of the combustion device, which may include adding cavities and/or resonators to the combustion chamber. However, redesigning the combustion chamber may require significant economic resources and can be impracticable. Further, many combustion devices can be used in a variety of combustion chambers, making it difficult to predict combustion resonance prior to the commissioning of the combustion device.

Other approaches include dampening the combustion resonance by modifying acoustic pressures in the combustion chamber using speakers and/or modulating heat release rate by changing fuel flow at acoustic frequencies. However, these approaches require advanced control approaches based on a complex model of the specific combustion chamber/device combination.

DETAILED DESCRIPTION

Figure 1:
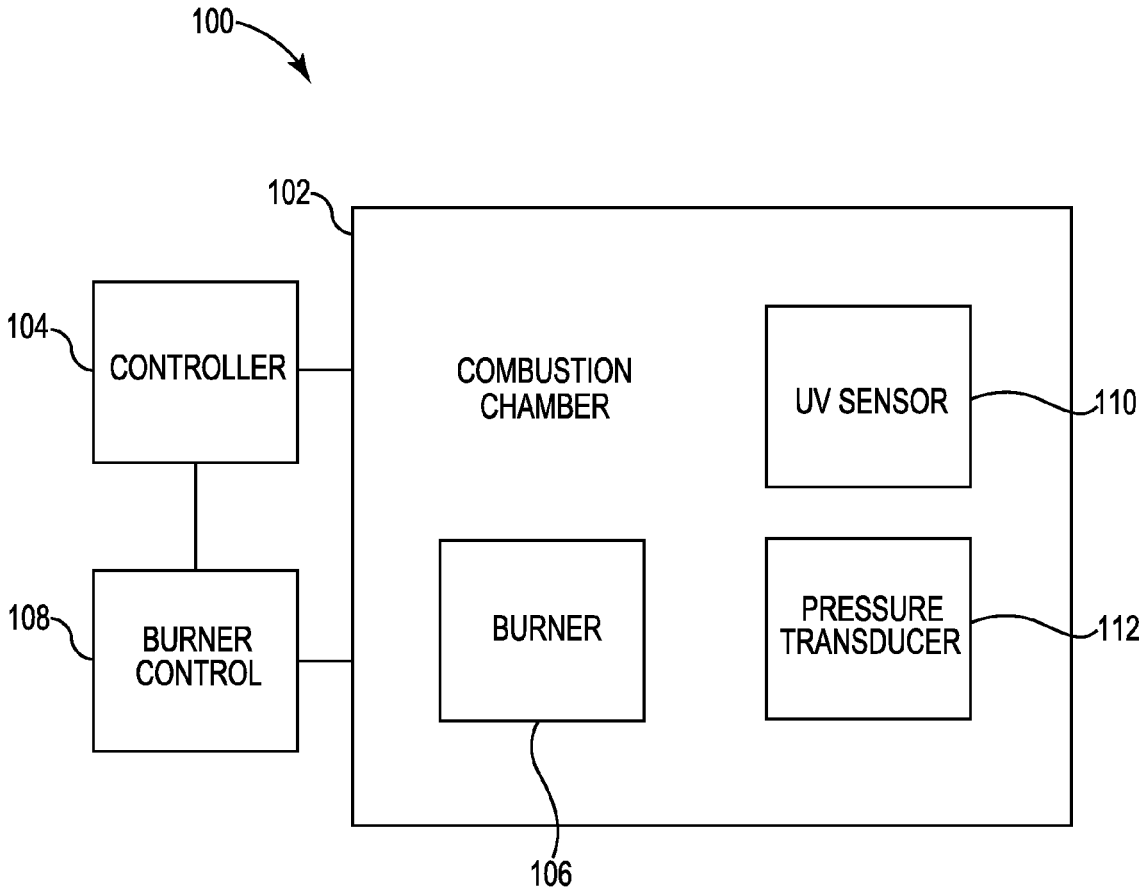
FIG. 1 illustrates a system for combustion resonance suppression, in accordance with one or more embodiments of the present disclosure.

Methods, devices, and systems for combustion resonance suppression are described herein. For example, one or more embodiments include a memory, and a processor configured to execute executable instructions stored in the memory to receive a number of operating conditions of a burner, determine whether resonance characteristics are present in a combustion chamber housing the burner based on the number of operating conditions of the burner, and modify at least one of an air supply and a fuel supply to the burner upon determining resonance characteristics are present in the combustion chamber.

Combustion resonance suppression, in accordance with the present disclosure, can allow for a semi-active control mechanism to suppress and prevent combustion resonance in a combustion device (e.g., a burner) from occurring. A controller can be utilized to quickly sense, process, and detect combustion and acoustics. Standard burner controls can be utilized to modify set points of the burner for combustion resonance detection and suppression without redesigning the combustion chamber of the burner. Further, costly repairs from noise (e.g., high intensity noise that may disturb persons near the burner), equipment fatigue and/or failure as a result of combustion resonance can be avoided.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, burner control 108 as shown in FIG. 1 can be burner control 208, as shown in FIG. 2.

As used herein, "a" or "a number of" something can refer to one or more such things. For example, "a number of operating conditions" can refer to one or more operating conditions.

Figure 2:
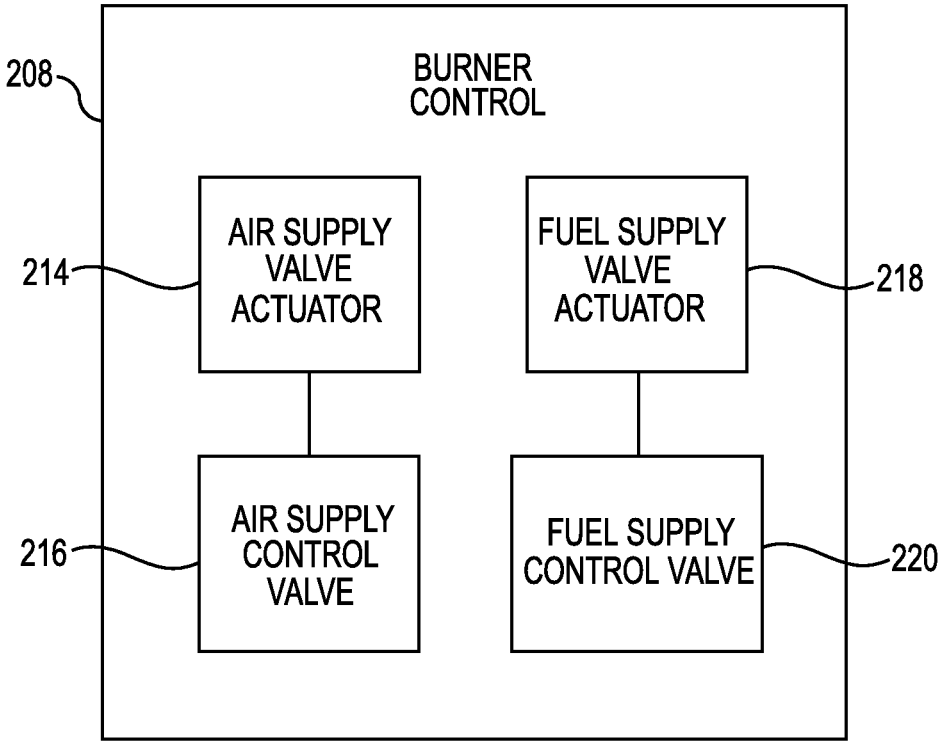
FIG. 2 is a schematic block diagram of a burner control for combustion resonance suppression, in accordance with one or more embodiments of the present disclosure.

FIG. 1 illustrates a system 100 for combustion resonance suppression, in accordance with one or more embodiments of the present disclosure. As shown in FIG. 1, the system 100 can include combustion chamber 102, controller 104, and burner control 108. Combustion chamber 102 can include burner 106, ultra-violet (UV) sensor 110, and pressure transducer 112.

Controller 104 can receive a number of operating conditions of burner 106 and determine whether resonance characteristics are present in combustion chamber 102 housing burner 106 based on the number of operating conditions of burner 106. Additionally, controller 104 can modify at least one of an air supply and a fuel supply to burner 106 based upon determining resonance characteristics are present in combustion chamber 102, as will be further described herein.

Resonance characteristics can be characteristics indicating a resonance state of burner 106. For example, resonance characteristics can include acoustic pressure oscillations that occur in combustion chamber 102. Acoustic pressure oscillations in combustion chamber 102 can disturb a pressure around a gas nozzle of burner 106, which can cause harmonic variations of a composition of an air and fuel mixture traveling between the gas nozzle of burner 106 and a combustion point (e.g., a flame) of burner 106 to become in phase with the acoustic pressure oscillations. This disturbance of the air and fuel mixture along with the acoustic pressure oscillations can be amplified if left unresolved, which may lead to flame extinction and/or equipment damage. The resonance state can comprise a narrow-band high intensity noise in combustion chamber 102. That is, the acoustic pressure oscillations can be a high intensity noise concentrated in a narrow frequency band (e.g., 10 hertz (Hz) to 20 Hz). For example, the acoustic pressure oscillations can be concentrated in a frequency band of 10 Hz to 13 Hz, although embodiments of the present disclosure are not so limited.

Burner 106 can be a fuel-air or fuel-oxygen burner that can produce (e.g., generate) a flame. For example, burner 106 can be used to produce a flame to generate heat for use in any suitable residential or commercial hot water boiler/heater application.

The number of operating conditions of burner 106 can include a pressure within combustion chamber 102 and a light emission of a flame within combustion chamber 102. The pressure within combustion chamber 102 can include an acoustic pressure generated by a sound wave. The light emission of the flame can include chemiluminiscence of radicals that can arise at certain stages of the combustion process (e.g., Hydroxyl (OH) or Methyl (CH) radicals). As used herein, a radical can be an atom, molecule, or ion that has unpaired valence electrons.

The chemiluminiscence of each radical can be of a specific wavelength. For example, the light emission of OH radicals can be at 309 nanometers (nm). That is, the light emission of chemiluminiscence can be in the ultra-violet (UV) radiation spectrum. Additionally, it can be easily distinguished from background light radiated from hot equipment. UV radiation can include electromagnetic radiation with a wavelength that can range from 10 nanometers (nm) to 400 nm.

The pressure within combustion chamber 102 can be received (e.g., by controller 104) from a pressure transducer 112 within combustion chamber 102. For example, pressure transducer 112 can be a dynamic pressure transducer such as a piezoelectric pressure sensor to measure acoustic pressure. Pressure transducer 112 can be located in combustion chamber 102. For example, pressure transducer 112 can be located in an opening of combustion chamber 102 where it is protected from heat. Pressure transducer 112 can transmit the measured pressure in combustion chamber 102 to controller 104 via a wired or wireless network. For example, pressure transducer 112 can transmit the measured pressure to controller 104 by an analog to digital converter.

Although pressure transducer 112 is described as a piezoelectric pressure sensor, embodiments of the present disclosure are not so limited. For example, pressure transducer 112 can be any other type of dynamic pressure transducer capable of measuring acoustic pressure.

The wired or wireless network can be a network relationship that connects pressure transducer 112 to controller 104. Examples of such a network relationship can include a local area network (LAN), wide area network (WAN), personal area network (PAN), a distributed computing environment (e.g., a cloud computing environment), and/or the Internet, among other types of network relationships.

Resonance characteristics present in combustion chamber 102 can cause an oscillating disturbance in the air and fuel mixture (e.g., the air-fuel ratio) near the nozzle of burner 106. The oscillating disturbance of the air and the fuel mixture can be carried towards the flame, reaching the flame in time corresponding to the mean flow velocity and the distance between the nozzle and the flame. The disturbance in the air and fuel mixture can cause heat release rate variations in the flame, which may affect acoustic pressure oscillations (e.g., amplify or dampen) depending on a phase difference between the acoustic pressure in combustion chamber 102 and the heat release rate oscillations. The phase difference between the acoustic pressure in combustion chamber 102 and the heat release rate oscillations can be on the travel time of the air and fuel mixture between the nozzle and the flame, and can be controlled by controlling the mean flow velocity.

Although not shown in FIG. 1 for clarity and so as not to obscure embodiments of the present disclosure, combustion chamber 102 can include more than one pressure transducer 112. For example, combustion chamber 102 can include multiple pressure transducers 112.

The light emission of the flame in combustion chamber 102 can be received (e.g., by controller 104) from a UV sensor 110 in combustion chamber 102. For example, UV sensor 110 can be a chemiluminiscence sensor with a UV photodiode capable of detecting light emission within the wavelength range of 10 nm to 400 nm. UV sensor 110 can transmit the measured light emission of the flame to controller 104 via a wired or wireless network (e.g., the same or analogous wireless network described in connection with pressure transducer 112).

Although UV sensor 110 is described as having a detection range from 10 nm to 400 nm, embodiments of the present disclosure are not so limited. For example, UV sensor 110 can have a detection range that is narrower than 10 nm to 400 nm (e.g., 300 nm to 400 nm) such that UV sensor 110 includes wavelengths associated with the relevant radicals.

The light emission of the flame in combustion chamber 102 can be correlated with the heat release rate of the flame. For example, heat release rate can be correlated with the chemiluminiscence of compounds present in combustion byproducts (e.g., methane) at certain wavelengths (e.g., wavelengths within the UV spectrum).

Controller 104 can determine whether resonance characteristics are present in combustion chamber 102 based on the pressure received from pressure transducer 112 and the light emission of the flame received from UV sensor 110. For example, controller 104 can determine that the pressure received from pressure transducer 112 and the light emission of the flame received from UV sensor 110 both contain significant periodic components of the same frequency using a resonance model for the particular resonance state.

The resonance model can include elements such as a harmonic oscillator characterizing an acoustic mode for combustion chamber 112 and linear elements modeling acoustic impedances such as a time delay related to a traveling time of the air and fuel mixture between the gas nozzle and the flame of burner 106. A non-linear memoryless function can characterize the response of heat release rate to acoustic velocity.

Once controller 104 has detected resonance characteristics, controller 104 can predict a deviation needed from present operating conditions of burner 106 in order to remove burner 106 from a resonance state. For example, controller 104 can identify an amount to modify an air supply and/or a fuel supply in order to remove burner 106 from a resonance state. That is, controller 104 can identify an amount of modification to the air supply and/or fuel supply set points to change the combustion environment in combustion chamber 102 so that a balance equation defined by known conditions of persistent oscillations is no longer valid (e.g., the travel time of the air and fuel mixture between the gas nozzle and the flame of burner 106 can be increased or decreased). Alternatively, controller 104 can identify an amount of modification to the air supply and/or fuel supply set points to change a memoryless function shape. For example, controller 104 can change a memoryless function shape by relating velocity deviation and heat release deviations from their mean values.

Controller 104 can have a high sampling rate. For example, controller 104 can sample acoustic the operating conditions of burner 106 (e.g., pressure and light emission) at a high sampling rate to capture the spectrum at which resonance can occur. For example, the sampling rate of controller 104 can be as high as 10 kilohertz (kHz), although embodiments of the present disclosure are not so limited. For example, controller 104 can have a sampling rate higher than 10 kHz or a sampling rate lower than 10 kHz. Processing the sampled operating conditions can be done at lower frequencies, as will be further described herein.

Resonance conditions within combustion chamber 102 can quickly cause flame extinction, equipment fatigue and/or failure in prolonged duration when fully developed. Therefore, determination of whether resonance characteristics are present and modification of the air and/or fuel supply to burner 106 must be done as quickly as possible. For example, the sampling rate of controller 104 being as high as 10 kHz can allow for quick detection of resonance characteristics and modification to remove burner 106 from the resonance state, ideally before the maximum oscillation amplitude of the resonance characteristics is reached.

Determining whether resonance characteristics are present in combustion chamber 102 based on the pressure can include applying a Fourier transform to the pressure received from pressure transducer 112. A Fourier transform can convert a signal from its original domain (e.g., time or space) to a frequency domain. For example, controller 104 can apply a Fast Fourier Transform (FFT) to the pressure received from pressure transducer 112.

Applying a Fourier transform to the pressure received from pressure transducer 112 can result in a frequency domain value of the delay in the mean travel time of the air and fuel mixture between the gas nozzle and the combustion point of burner 106. The frequency domain value of the delay in the mean travel time can be used to determine whether resonance characteristics are present in combustion chamber 102, as will be further described herein.

Although controller 104 is described as applying an FFT to the pressure received from pressure transducer 112, embodiments of the present disclosure are not so limited. For example, controller 104 can apply a Discrete Fourier Transform or a short-time Fourier Transform to the pressure received from pressure transducer 112, among other types of Fourier transforms.

Controller 104 can apply a Fourier transform to the pressure received from pressure transducer 112 at a rate much lower than the sampling rate of controller 104. For example, controller 104 can apply a Fourier transform to the pressure from pressure transducer 112 at 10 Hz. Applying a Fourier transform at a rate lower than the sampling rate of controller 104 can allow for a longer Fourier transform window length. The longer Fourier transform window length can allow for higher accuracy in detecting lower frequency acoustic pressure oscillations.

Although controller 104 is described as applying a Fourier transform to the pressure received from pressure transducer 112 at a rate of 10 Hz, embodiments of the present disclosure are not so limited. For example, controller 104 can apply a Fourier transform to the pressure received from pressure transducer 112 at a rate higher than 10 Hz or lower than 10 Hz.

Determining whether resonance characteristics are present in combustion chamber 102 based on the light emission of the flame can include applying a Fourier transform to the light emission of the flame received from UV sensor 110. For example, controller 104 can apply a FFT to the light emission of the flame received from UV sensor 110.

Applying a Fourier transform to the light emission of the flame received from UV sensor 110 can result in a frequency domain value of the heat release of the flame of burner 106. The frequency domain value of the heat release of the flame of burner 106 can be used to determine whether resonance characteristics are present in combustion chamber 102, as will be further described herein.

Although controller 104 is described as applying an FFT to the light emission of the flame received from UV sensor 110, embodiments of the present disclosure are not so limited. For example, controller 104 can apply a Discrete Fourier Transform or a short-time Fourier Transform to the light emission of the flame received from UV sensor 110, among other types of Fourier transforms.

Similar to the pressure from pressure transducer 112, controller 104 can apply a Fourier transform to the light emission of the flame received from UV sensor 110 at a rate much lower than the sampling rate of controller 104. For example, controller 104 can apply a Fourier transform to the light emission of the flame from UV sensor 110 at 10 Hz.

Although controller 104 is described as applying a Fourier transform to the light emission of the flame received from UV sensor 110 at a rate of 10 Hz, embodiments of the present disclosure are not so limited. For example, controller 104 can apply a Fourier transform to the light emission of the flame received from UV sensor 110 at a rate higher than 10 Hz or lower than 10 Hz.

The resonance state can include a largest peak magnitude of the pressure and a largest peak magnitude of the light emission of the flame occurring at a same frequency. That is, the Fourier transform of the pressure and the Fourier transform of the light emission of the flame may include a peak magnitude that occurs at the same frequency for both signals. The largest peak magnitudes of the pressure and the light emission of the flame occurring at the same frequency can indicate resonance characteristics being present in combustion chamber 102, and as a result, burner 106 being in a resonance state.

For example, the largest peak magnitude of the pressure and the largest peak magnitude of the light emission of the flame can occur at a frequency of 20 Hz, indicating burner 106 being in a resonance state. As another example, the largest peak magnitude of the pressure and the largest peak magnitude of the light emission of the flame can occur at a frequency of 30 Hz, indicating burner 106 being in a resonance state.

Controller 104 can modify at least one of an air supply and a fuel supply to burner 106 upon determining the resonance characteristics are present in combustion chamber 102. Controller 104 can modify the air and/or fuel supply to burner 106 to remove burner 106 from the resonance state. For instance, controller 104 can modify the air and/or fuel supply such that the peak magnitude of the pressure and the peak magnitude of the light emission of the flame do not occur at the same frequency. For example, removing burner 106 from the resonance state can include modifying the air and/or fuel supply so that the air and fuel mixture traveling between the gas nozzle of burner 106 and the combustion point of burner 106 is out of phase with the acoustic pressure oscillations within combustion chamber 102.

Modifying the air supply to burner 106 can include modifying a volumetric air flow rate of the air supply to burner 106. For example, the air supply to burner 106 can be adjusted to increase or decrease the volumetric air flow rate of the air supply to burner 106.

Controller 104 can modify the air flow rate of the air supply to burner 106 by transmitting control signals to burner control 108 via a wired or wireless network. Burner control 108 can be a control system that controls a number of actuators associated with a number of control valves of burner 106, as will be described in connection with FIG. 2.

Modifying the fuel supply to burner 106 can include modifying a volumetric fuel flow rate of the fuel supply to burner 106. For example, the fuel supply to burner 106 can be adjusted to increase or decrease the volumetric fuel flow rate of the fuel supply to burner 106. Controller 104 can modify the fuel supply to burner 106 by transmitting control signals to burner control 108 via a wired or wireless network.

Modifying the at least one of the air supply and the fuel supply can include modifying the air and/or fuel supply within a safe operating range of burner 106. That is, the air and/or fuel supply to burner 106 can be modified to remove burner 106 from a resonance state while keeping burner 106 within process limits of burner 106.

In some embodiments, burner control 108 can include process limits that may not be exceeded when modifying the air and/or fuel supply to burner 106. The process limits can be maintained so that burner 106 is not damaged as a result of the air supply to burner 106 being adjusted too high or too low and/or the fuel supply to burner 106 being adjusted too high or too low. Additionally, modifications to the air and/or fuel supply to burner 106 that may produce emissions (e.g., carbon monoxide, $NO_x$, and/or other emissions) that have a concentration higher than an acceptable limit can be avoided.

Modifying the at least one of the air supply and the fuel supply can include modifying the air and/or fuel supply by the lowest amount needed to remove burner 106 from the resonance state. That is, the air and/or fuel supply may be modified by the lowest amount possible in order to keep the air flow and fuel flow as close to the resonance state set points as possible and still remove burner 106 from the resonance state. For example, modifying the air and/or fuel supply by the lowest amount needed to remove burner 106 from the resonance state can maintain process limits of burner 106 from burner control 108 in order to avoid damage to equipment and/or maintain emissions constraints.

The lowest modification amount needed to remove burner 106 from the resonance state can be determined by determining a modification to at least one of the air supply and the fuel supply to result in elimination of persistent oscillations of the resonance state (e.g., a phase shift of the frequency of a largest peak magnitude of the pressure and a largest peak magnitude of the flame). For example, controller 104 can determine the phases of the acoustic pressure and the flame light emission as well as the mean travel time of the air and fuel mixture between the gas nozzle and the combustion point of burner 106. Controller 104 can then determine (e.g., calculate) possible air supply and/or fuel supply adjustments using the determined phases and an empirical relation between the air supply and the phase difference. The empirical relation can be obtained by computer simulation and does not depend on the type of combustion chamber burner 106 is housed within.

In some embodiments, controller 104 can save the number of operating conditions of burner 106 to a resonance map upon determining resonance characteristics are present in combustion chamber 102. For example, once resonance characteristics are determined to be present in combustion chamber 102, controller 104 can save the current values of the pressure received from pressure transducer 112 and the light emission of the flame received from UV sensor 110 to the resonance map. The values of the air supply (e.g., the volumetric air flow rate) and/or the fuel supply (e.g., the volumetric fuel flow rate) to burner 106 associated with the pressure and light emission of the flame can also be saved to the resonance map.

The resonance map can include a number of saved operating conditions of burner 106 corresponding to resonance characteristics determined to be present in combustion chamber 102. Each of the number of operating conditions of burner 106 in which resonance characteristics were detected in combustion chamber 102 can be associated with operating conditions of burner 106 (e.g., pressure, light emission of the flame). Further, corresponding values of the air supply (e.g., volumetric air flow rate) and the fuel supply (e.g., volumetric fuel flow rate) can be included in the resonance map.

The number of previously saved operating conditions of burner 106 included in the resonance map can be avoided when modifying at least one of the air supply and the fuel supply as a result of a current resonance state of burner 106. That is, when resonance characteristics are determined to be present in combustion chamber 102, values saved in the resonance map corresponding to previous resonance states can be avoided when modifying an air supply and/or a fuel supply to remove burner 106 from the current resonance state.

For example, a current resonance state of burner 106 can occur at a volumetric air flow rate of 206 $m^3$/hour, and a previous resonance state can be associated with a volumetric air flow rate of 210 $m^3$/hour. The air supply to burner 106 can be modified to 208 $m^3$/hour to remove burner 106 from the resonance state while avoiding operating conditions associated with a previous resonance state.

Controller 104 can continuously repeat the method for combustion resonance suppression throughout operation of burner 106. For example, controller 104 can continuously receive the number of operating conditions of burner 106 while burner 106 is in operation, and determine whether resonance characteristics are present in combustion chamber 102 based on the pressure and the light emission of the flame received from pressure transducer 112 and UV sensor 110, respectively. Further, controller 104 can modify at least one of an air supply and a fuel supply to burner 106 upon determining the resonance characteristics are present in combustion chamber 102 in order to remove burner 106 from the resonance state.

If resonance characteristics are determined to not be present in combustion chamber 102, controller 104 may not modify the air supply and/or the fuel supply to burner 106. That is, if no resonance characteristics are present in combustion chamber 102, burner 106 is determined to not be in a resonance state and the air supply and/or the fuel supply to burner 106 is maintained.

FIG. 2 illustrates a schematic block diagram of a burner control 208 for combustion resonance suppression, in accordance with one or more embodiments of the present disclosure. Burner control 208 can be, for example, burner control 108 previously described in connection with FIG. 1. As shown in FIG. 2, burner control 208 can include an air supply valve actuator 214, an air supply control valve 216, a fuel supply valve actuator 218, and a fuel supply control valve 220.

As used herein, a valve can be a device that regulates and/or controls the flow of a fluid. For example, air supply control valve 216 can regulate and/or control the flow of air to a burner (e.g., burner 106, described in connection with FIG. 1). As another example, fuel supply control valve 220 can regulate and/or control the flow of fuel to a burner (e.g., burner 106, described in connection with FIG. 1).

As used herein, an actuator can be a motor that can control a mechanism (e.g., a valve). For example, air supply valve actuator 214 can be a motor that can control air supply control valve 216. As another example, fuel supply valve actuator 218 can be a motor that can control fuel supply control valve 220.

The air supply to the burner (e.g., burner 106) can be modified by air supply valve actuator 214 controlling air supply control valve 216. For example, burner control 208 can receive control signals from a controller (e.g., controller 104) to modify the volumetric air flow rate of the air supply to the burner. Burner control 208 can modify (e.g., increase or decrease) the volumetric air flow rate to the burner by sending a logic signal to air supply valve actuator 214 to modify (e.g., open or close) air supply control valve 216.

Modifying air supply control valve 216 can include partially opening or partially closing air supply control valve 216. For example, the volumetric air flow rate to the burner can be increased from 210 $m^3$/hour to 212 $m^3$/hour by partially opening air supply control valve 216. As another example, the volumetric air flow rate to the burner can be decreased from 210 $m^3$/hour to 209 $m^3$/hour by partially closing air supply control valve 216.

The fuel supply to the burner (e.g., burner 106) can be modified by fuel supply valve actuator 218 controlling fuel supply control valve 220. For example, burner control 208 can receive control signals from a controller (e.g., controller 104) to modify the volumetric fuel flow rate of the fuel supply to the burner. Burner control 208 can modify (e.g., increase or decrease) the volumetric fuel flow rate to the burner by sending a logic signal to fuel supply valve actuator 218 to modify (e.g., open or close) fuel supply control valve 220.

Figure 3:
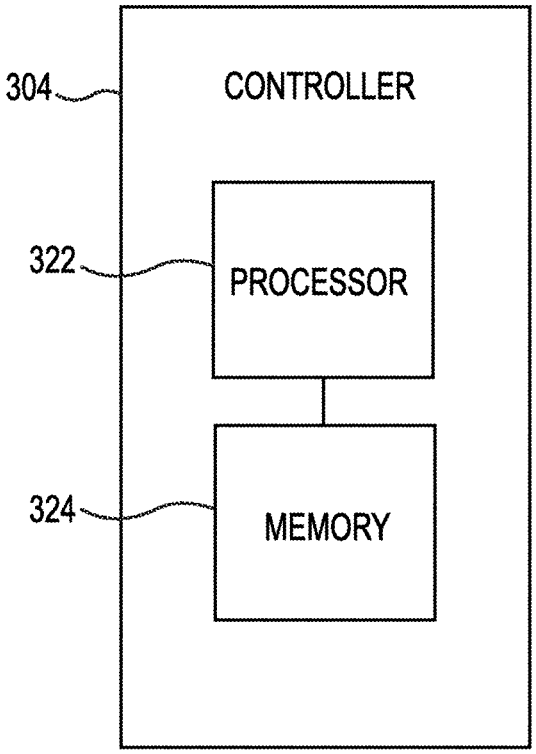
FIG. 3 is a schematic block diagram of a controller for combustion resonance suppression, in accordance with one or more embodiments of the present disclosure.

FIG. 3 is a schematic block diagram of a controller 304 for combustion resonance suppression, in accordance with one or more embodiments of the present disclosure. Controller 304 can be, for example, controller 104, previously described in connection with FIG. 1. Controller 304 can include a memory 324 and a processor 322 configured for combustion resonance suppression, in accordance with the present disclosure.

The memory 324 can be any type of storage medium that can be accessed by the processor 322 to perform various examples of the present disclosure. For example, the memory 324 can be a non-transitory computer readable medium having computer readable instructions (e.g., computer program instructions) stored thereon that are executable by the processor 322 to receive a number of operating conditions of a burner and determine whether resonance characteristics are present in a combustion chamber housing the burner based on the number of operating conditions of the burner. Further, processor 322 can execute the executable instructions stored in memory 324 to modify at least one of an air supply and a fuel supply to the burner upon determining resonance characteristics are present in the combustion chamber.

The memory 324 can be volatile or nonvolatile memory. The memory 324 can also be removable (e.g., portable) memory, or non-removable (e.g., internal) memory. For example, the memory 324 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 324 is illustrated as being located within controller 304, embodiments of the present disclosure are not so limited. For example, memory 324 can also be located internal to another computing resource (e.g., enabling computer readable instructions to be downloaded over the Internet or another wired or wireless connection).

Figure 4:
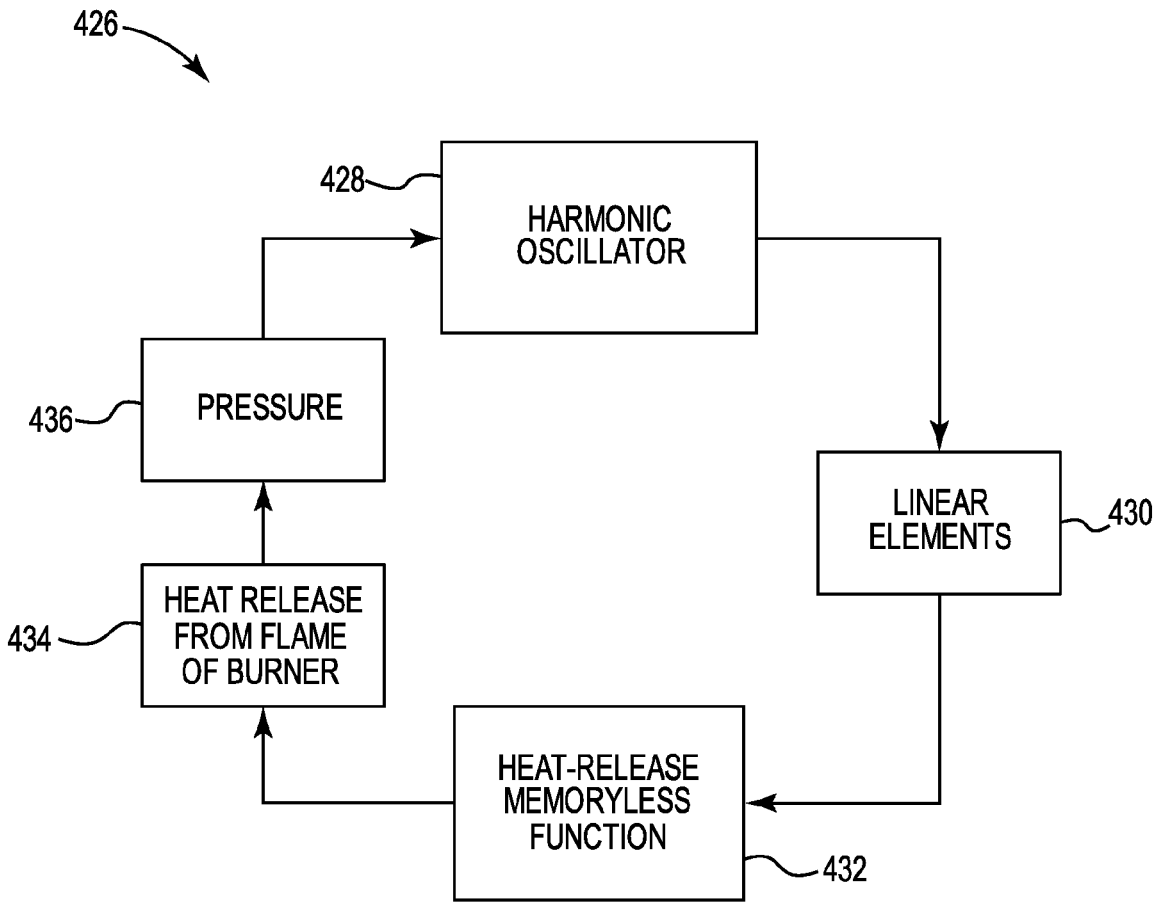
FIG. 4 illustrates a resonance model for combustion resonance suppression, in accordance with one or more embodiments of the present disclosure.

FIG. 4 illustrates a resonance model 426 for combustion resonance suppression, in accordance with one or more embodiments of the present disclosure. As shown in FIG. 4, the resonance model 426 can include a harmonic oscillator 428, linear elements 430, heat-release memoryless function 432, heat release from flame of burner 434, and pressure 436.

If a resonance state is detected, a resonance model 426 can be invoked. The resonance model 426 can include elements such as harmonic oscillator 428 characterizing an acoustic mode for a combustion chamber (e.g., combustion chamber 112, previously described in connection with FIG. 1) and linear elements 430 modeling acoustic impedances.

Linear elements 430 can include a time delay related to a traveling time of the air and fuel mixture between the gas nozzle and the flame of a burner (e.g., burner 106, previously described in connection with FIG. 1). The time delay can be obtained from a FFT of pressure 436 and heat release from flame of burner 434 data. Pressure 436 can be received from a pressure transducer (e.g., pressure transducer 112, previously described in connection with FIG. 1). Heat release from flame of burner 434 can be characterized by a light emission from the flame in the combustion chamber of the burner, and can be detected by a UV sensor (UV sensor 110, previously described in connection with FIG. 1), respectively.

A heat-release memoryless function 432 can characterize the response of the heat release from flame of burner 434 to a velocity of the air and fuel mixture traveling from the nozzle to the burner. The heat-release memoryless function 432 can be a non-linear memoryless function.

Resonance model 426 can be used to efficiently respond to a resonance state corresponding to operating conditions saved in a resonance map (e.g., a resonance map previously described in connection with FIG. 1) to remove the burner from the resonance state. Further, operating conditions of the burner corresponding to a resonance state not previously saved can be saved to the resonance map.

As used herein, "logic" is an alternative or additional processing resource to execute the actions and/or functions, etc., described herein, which includes hardware (e.g., various forms of transistor logic, application specific integrated circuits (ASICs), etc.), as opposed to computer executable instructions (e.g., software, firmware, etc.) stored in memory and executable by a processor. It is presumed that logic similarly executes instructions for purposes of the embodiments of the present disclosure.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A controller for combustion resonance suppression, comprising:
- a memory;
- a processor configured to execute executable instructions stored in the memory to:
  - receive a number of operating conditions of a burner;
  - determine whether resonance characteristics are present in a combustion chamber housing the burner based on the number of operating conditions of the burner;
  - save, to a resonance map, the number of operating conditions of the burner upon determining that resonance characteristics are present;
  - modify at least one of an air supply and a fuel supply to the burner upon determining resonance characteristics are present in the combustion chamber; and
  - avoid, a number of saved operating conditions of the resonance map, when modifying at least one of the air supply and the fuel supply.

2. The controller of claim 1, wherein the number of operating conditions of the burner include:
- a pressure within the combustion chamber; and
- a light emission of a flame within the combustion chamber.

3. The controller of claim 2, wherein the pressure within the combustion chamber is received from a pressure transducer in the combustion chamber.

4. The controller of claim 2, wherein the light emission of the flame is received from an ultra-violet (UV) sensor in the combustion chamber.

5. The controller of claim 1, wherein the resonance characteristics indicate a resonance state of the burner.

6. The controller of claim 5, wherein the resonance state comprises a narrow-band high intensity noise in the combustion chamber.

7. A computer implemented method for combustion resonance suppression, comprising:
- receiving, by a controller, a number of operating conditions of a burner, including:
  - a pressure from a pressure transducer within a combustion chamber housing the burner; and
  - a light emission of a flame within the combustion chamber housing the burner from an ultra-violet (UV) sensor in the combustion chamber housing the burner;
- determining, by the controller, whether resonance characteristics are present in the combustion chamber based on the pressure and the light emission of the flame;
- saving, to a resonance map, the number of operating conditions of the burner upon determining that resonance characteristics are present;
- modifying, by the controller, at least one of an air supply and a fuel supply to the burner upon determining the resonance characteristics are present in the combustion chamber to remove the burner from a resonance state; and
- avoiding, a number of saved operating conditions of the resonance map, when modifying at least one of the air supply and the fuel supply.

8. The method of claim 7, wherein determining whether resonance characteristics are present in the combustion chamber includes:
- applying a Fourier transform to the pressure; and
- applying a Fourier transform to the light emission of the flame.

9. The method of claim 7, wherein the resonance state includes a largest peak magnitude of the pressure and a largest peak magnitude of the light emission of the flame occurring at a same frequency.

10. The method of claim 7, wherein modifying the air supply to the burner includes modifying a volumetric air flow rate of the air supply.

11. The method of claim 7, wherein modifying the fuel supply to the burner includes modifying a volumetric fuel flow rate of the fuel supply.

12. The method of claim 7, wherein modifying the air supply to the burner includes modifying an actuator controlling an air supply control valve and wherein modifying the fuel supply to the burner includes modifying an actuator controlling a fuel supply valve.

13. The method of claim 7, wherein the at least one of the air supply and the fuel supply are modified within a safe operating range of the burner.

14. The method of claim 7, wherein the method is continuously repeated throughout operation of the burner.

15. A system for combustion resonance suppression, comprising:
- a burner;
- a combustion chamber housing the burner; and
- a controller, configured to:
  - receive, from a number of sensors, a number of operating conditions of a burner, including:
    - a pressure from a pressure transducer within the combustion chamber; and
    - a light emission of a flame within the combustion chamber from an ultra-violet (UV) sensor in the combustion chamber;

determine whether resonance characteristics are present in the combustion chamber based on the pressure and the light emission of the flame;

save, to a resonance map, the number of operating conditions of the burner including the pressure and the light emission of the flame upon determining that resonance characteristics are present;

modify at least one of an air supply and a fuel supply to the burner upon determining the resonance characteristics are present in the combustion chamber; and avoid, a number of saved operating conditions of the resonance map including the pressure and the light emission of the flame, when modifying at least one of the air supply and the fuel supply.

16. The system of claim 15, wherein at least one of the air supply and the fuel supply are modified by a lowest amount needed to remove the burner from a resonance state.

17. The system of claim 16, wherein the lowest modification amount needed to remove the burner from the resonance state is determined by determining, by the controller, a modification to at least one of the air supply and the fuel supply to result in elimination of persistent oscillations of the resonance state.

18. The system of claim 15, wherein the controller does not modify at least one of the air supply and the fuel supply upon determining that no resonance characteristics are present in the combustion chamber.

* * * * *